United States Patent [19]

Sorbier

[11] 4,018,394

[45] Apr. 19, 1977

[54] SHREDDING MACHINE FOR FIBROUS MATERIALS

[75] Inventor: Pierre Sorbier, Pernes-les-Fontaines, France

[73] Assignee: Agence Nationale de Valorisation de la Recherche (ANVAR), Neuilly-sur-Seine, France

[22] Filed: Nov. 24, 1975

[21] Appl. No.: 634,344

[30] Foreign Application Priority Data

Nov. 25, 1974 France ..... 74.39951

[52] U.S. Cl. ..... 241/200; 144/2 R; 144/242 D; 241/242

[51] Int. Cl.[2] ..... B02C 19/00

[58] Field of Search ... 241/200, 235, 242, DIG. 17; 144/2 R, 242 D

[56] References Cited

UNITED STATES PATENTS

| | | | |
|---|---|---|---|
| 77,102 | 4/1868 | Rymes | 241/200 |
| 2,642,904 | 6/1953 | Pearce | 241/200 X |
| 2,711,834 | 6/1955 | Broberg et al. | 241/200 X |
| 2,936,008 | 5/1960 | Brown | 241/200 X |
| 3,275,049 | 9/1966 | Gunn | 144/242 D X |

FOREIGN PATENTS OR APPLICATIONS

| | | | |
|---|---|---|---|
| 328,321 | 10/1920 | Germany | 241/200 |
| 71,296 | 11/1952 | Netherlands | 241/200 |

*Primary Examiner*—Roy Lake
*Assistant Examiner*—Howard N. Goldberg
*Attorney, Agent, or Firm*—Brisebois & Kruger

[57] ABSTRACT

The invention relates to a shredding machine, more particularly for shredding fibrous, lignin-containing or analogous materials. It comprises an endless belt carrying grinding tools such as gouges and forming an upper lap onto which the material to be defibred is delivered. The front portion of said belt rotates about a countershaft. The shredding machine, moreover, comprises a fixed end stop member located above the countershaft, while the lower profile of said stop member is adapted to the passage of the gouges. Means are also provided which cooperate with the said stop member to prevent the passage of thick fragments of the material to be defibred. The invention can in particular be applied to the grinding or defibring of pieces of wood, logs, branches, planks and similar lignin-containing materials.

12 Claims, 13 Drawing Figures

Fig. 5
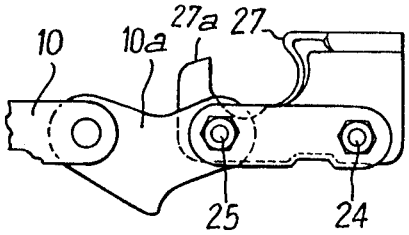
Fig. 3
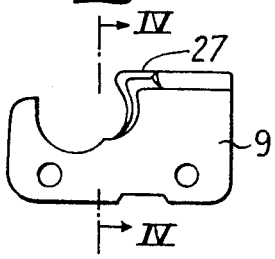
Fig. 4
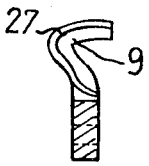
Fig. 6
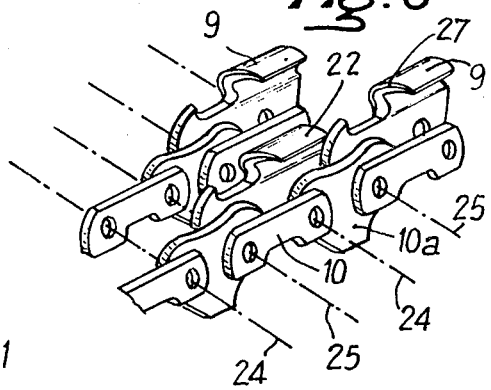
Fig. 7
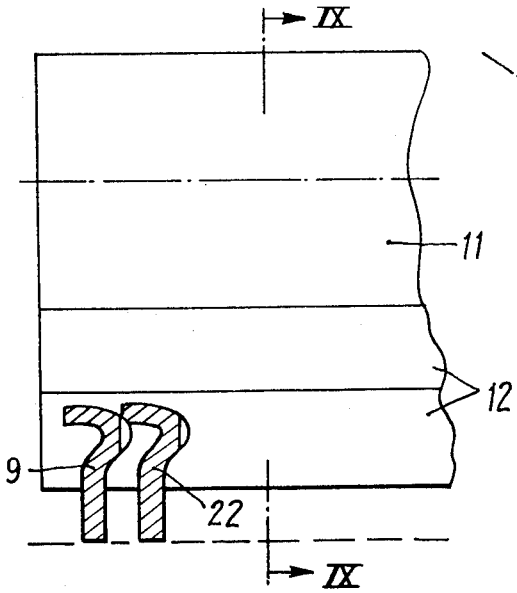
Fig. 9
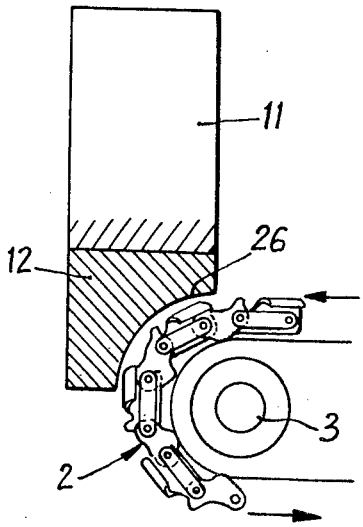
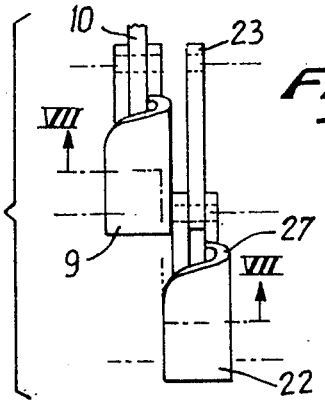
Fig. 8

SHREDDING MACHINE FOR FIBROUS MATERIALS

The present invention relates to a shredding device for use more particularly in facilitating and improving the fibre breaking or grinding of pieces of wood or lignin-containing materials, logs, branches, planks and the like.

In particular, this machine is intended to facilitate grinding operations and improve the percentage of fibres which are in fact shredded.

The hitherto known machines have the following disadvantages:

- at the end of the operation, the shredding device drags along the remaining thickness of the log, branch or saw timber which is either lost or jams against an end member;
- a satisfactory result is only obtained by providing a complex device which is intended particularly to ensure the relative and synchronized movements of a plurality of members.

In all cases, the performance, i.e. the volume of usable fibres obtained from a given log or fibrous material is relatively low. Moreover, the size of these fibres is not homogeneous.

In particular wood fragments can mix therewith when the log jams at the end of the operation.

The object of the present invention is to avoid these disadvantages and provide a new shredding machine, of simple construction and which permits the total fibre breaking of the material introduced, whilst permitting a continuous feed, resulting in a drop in the cost price and the obtaining of regular fibres intended more particularly for moulding agglomerated members.

The invention has for its object a shredding machine, more particularly intended for shredding fibrous materials, with an endless belt, for example comprising a plurality of juxtaposed chains carrying grinding tools such as gouges and forming an upper lap onto which is introduced the material to be ground. The front portion of the said lap rotates about a countershaft, and the machine comprises a fixed end stop above the said shaft, the lower stop profile being adapted to the passage of the gouges or teeth. Means are provided which cooperate with the said stop member to prevent the passage of any residual thicknesses or "slabs" of material to be ground.

Advantageously, the said stop member has, facing the belt portion wound the said shaft, a lower profile in the form of a circular arc at a limited distance from the top of the gouges, the beginning of the said arc being located at a lower level than the path of travel of the gouge teeth on the upper lap, preferably at least one centimeter lower.

Advantageously, the arc profile of the said stop member extends over a relatively considerable length, whereby the end of the said arc does not in any case substantially pass beyond a horizontal plane passing through the countershaft axis.

According to a first embodiment, the means for preventing the passage of residue or slabs comprise a grooved transverse roller located above the upper lap of the chain belt, whereas the said grooved roller rotates in a direction such that the member to be defibred moves in the opposite direction to the gouges.

According to another embodiment, a sealed chamber is located facing the said countershaft, behind the said stop member. This chamber is partially defined by a member located in the immediate vicinity of the path of the gouge teeth beneath the said shaft in such a way that large fragments or slabs which are moved beyond the stop member, are accumulated in the said chamber on separating from the belt under the action of centrifugal force, then being packed in the chamber and progressively shredded by the gouges, whilst being prevented from being discharged whole by the said member located adjacent to the lower portion of the countershaft. Experience has shown that all the large fragments which combine to pass beyond the said stop member are accumulated in the chamber where they are shredded, and only the very small fibres, corresponding to the gouge characteristics can be discharged from the chamber and separated from the belt, whereby they are then collected.

According to another embodiment, the said chamber is ommitted, but a second stop surface is provided beneath the lower portion of the countershaft at a certain angular distance from the furthest downstream end of the said stop member. This auxiliary stop prevents the passage towards the lower side of large or thick fragments which cannot mix with the fibres.

Experience has shown that large or thick fragments which succeed in getting past the stop member are discharged under the action of centrifugal force and are prevented from accompanying the belt beyond the said auxiliary stop.

According to another characteristic, the upper lap of the chain belt is supported and guided by a support table located between the upper lap and the lower lap.

According to another characteristic, each chain comprises at least two types of links, namely:

- a shreddng link having on the outside of the endless belt a cutting tooth with a lateral profile;
- one or several connecting links between two shredding links of the same chain and having on the inner surface of a endless belt the protuberance permitting the guidance of the chain on the support table for the upper lap.

According to another characteristic, those links of the various chains which are in registration with each other transversely of the belt are mounted on common transverse pins, with each pin carrying a shredding link of one chain and a connecting link of the adjacent chain whereby the shredding profiles of two adjacent chains are slightly staggered during the longitudinal movement of the belt, in such a way that the upper active lap of the chain belt works over the entire width of the log or fibrous material to be shredded.

The gouges on the chains have, in substantially equal numbers, cutting edges directed to the right and to the left. Thus, a gouge with a cutting edge directed to the right has its passage partly intersected by a gouge with its cutting edge to the left and vice versa.

According to another characteristic, the same motor set drives the driving shaft of the chain belt and the transverse grooved roller located to the rear of the vertical end stop member and above the upper side of the chain belt and of the material to be shredded. An intermediate gear or the like is provided between the shaft and the roller in such a way that the upper lap of the chain belt drives the wood towards the end stop, whilst the grooved and vertically regulatable shaft drives wood in the opposite direction. Thus, the essential function of the grooved shaft or roller is to prevent the wood from sticking and jamming between the front of the upper side of the chain belt and the end stop, when the fibrous member or log is almost completely shredded.

According to another characteristic, the lower front profile of a metal comb fixed to the lower portion of the stop member, at about two millimeters above the upper lap of the chain belt is provided on the one hand to shred the rear end of the material when the latter is sufficiently short to escape from the grooved roller and on the other hand to retain the waste material which has not been defibred.

According to another characteristic, the grinding machine has a pressing member constituted by a surface articulated about a horizontal transverse shaft, whilst elastic restoring means bias this pressing member against the upper surface of the member to be shredded, which is thus flattened against the upper side of the chain belt.

According to other characteristics, the fibrous materials to be shredded are supplied continuously via a hopper, whose lower portion opens out to the rear of a plane slightly inclined towards the front and bottom up to the rear of the upper lap of the chain belt, which effects a longitudinal movement from the back to the front.

Hereinafter various embodiments of the invention will be explained in an illustrative manner with reference to the attached drawings, in which:

FIG. 3 is a side view of a fibre breaking or shredding link.

FIG. 4 is a cross-section through said link taken along the line IV—IV in FIG. 3.

FIG. 5 is a side view showing an embodiment of the shredding chain belt.

FIG. 6 is a perspective view showing the relative position of the shredding links on the successive chains of the belt.

FIG. 7 is a cross-section taken along the line VII—VII in FIG. 8 through the shredding teeth adjacent to the lower comb of the stop member.

FIG. 8 is a plan view of the teeth adjacent to the end stop member.

FIG. 9 is a section taken along the line IX—IX of FIG. 7 showing the passage of the chains beneath the comb profile.

Figure 1:
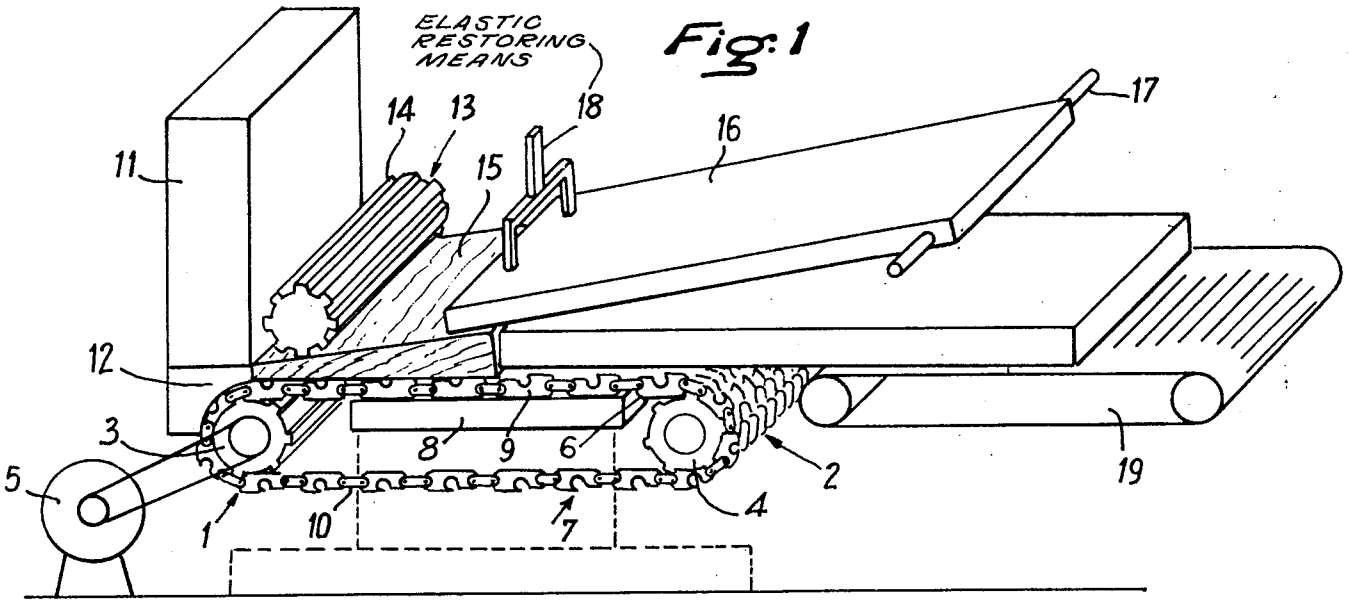
FIG. 1 is an overall view of the machine according to the invention.

The machine according to the invention, shown in FIG. 1 has a series of chains 1 located parallel to one another in such a way as to form an endless belt 2, which circulates about two grooved transverse shafts 3 and 4. Shaft 3 is rotated from a motor set 5. This belt has an upper lap 6 and a lower lap 7 which are substantially horizontal. The upper lap 6 of chain belt 2 is supported and guided by a support table 8 during the longitudinal displacement of this upper lap from the rear roller 4 to a front driving shaft 3.

Each chain 1 comprises two types of alternately fitted links, namely a shredding or defibring link 9 and then a connecting link 10. It can also have a so-called supporting link 10*a* (FIGS. 3 to 5).

Slightly above front shaft 3 the machine has a stop member 11 located in a substantially vertical plane. A stop 12, for example in the form of a metal comb, is fitted to the lower end of the said stop member just above roller 3 and the upper lap 6 of the chain belt. This comb has a transverse profile which cooperates with that of the teeth of the shredding link 9.

A transverse grooved roller 13 is located to the rear of the said stop member and above the chain belt. It is caused to rotate by a motor set 5 through a set of intermediate pinions (not shown), so that it rotates in the same direction as shaft 3. A regulating device (not shown) ensures the contact between grooves 14 and the upper surface of the material 15 to be shredded.

The macine finally has a pressure plate 16 articulated in its rear portion about a transverse shaft 17 mounted on the machine frame. The front portion of this plate is subject to the action of an elastic restoring system 18 to flatten the materials 15 against the upper lap of the chain belt.

As a variant, this restoring system can advantageously be replaced by one or more weights, for example made from wood which bear by gravity on the members to be shredded.

A feed mechanism 19 located in a horizontal plane and to the rear of this upper lap 6 ensures the continuous operation of the defibring process (FIG. 1).

Figure 2:
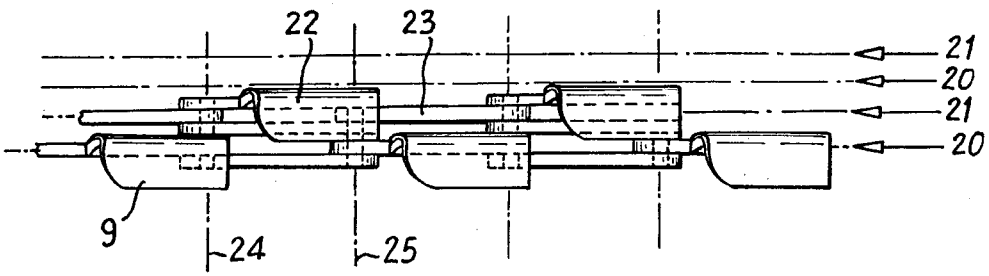
FIG. 2 is a plan view of the chain belt.

The arrangement of the successive chains 20, 21, etc of the belt 2 is illustrated by FIGS. 2 and 6. The shredding links 9 of chain 20 are all disposed in the same longitudinal vertical plane and are interconnected by narrower secondary links 10. The connections between the secondary links and the shredding links are articulated, permitting the formation of an endless chain.

The adjacent chain 21, juxtaposed with chain 20 has teeth 22 and secondary links 23 which are staggered relative to the corresponding elements of chain 20 by a distance equal to half the gap between two successive teeth on one chain.

The teeth 9 of chains 20, on the one hand and the teeth 22 of chains 21, on the other, are mounted on common transverse axes 24, 25. The chains 21 are positioned thereon in such a way that the shredding teeth 22 (whereof a profile is shown in FIGS. 3 and 4) has a longitudinal zone which is partly superimposed widthwise with the working zone of each of the adjacent chains 20 and 20*a* (FIGS. 2 and 8).

The defibring gouges or teeth are all shown with a cutting edge to the left, but it is obvious that the belt also has teeth with a cutting edge to the right, whereby the cutting edges to the right can for example alternate with those to the left on each chain.

FIGS. 7, 8 and 9 show the passage of the defibring teeth between on the one hand the comb 12 associated with the lower portion of the fixed stop member 11 and on the other the driving shaft 3 driving the chain belt. It can be seen that the profile 26 of comb 12 is adapted to the cutting edge trajectory of the defibring teeth 9.

It is obvious that the configuration of the chains (teeth and secondary links), driving means for the belt 2 and the nature of the pressure plate 16 and restoring means 18 can be different, for example so as to be adapted to the nature of the material to be shredded, to its dimensions or to the fineness of the fibres required, without passing beyond the scope of the invention.

Figure 11:
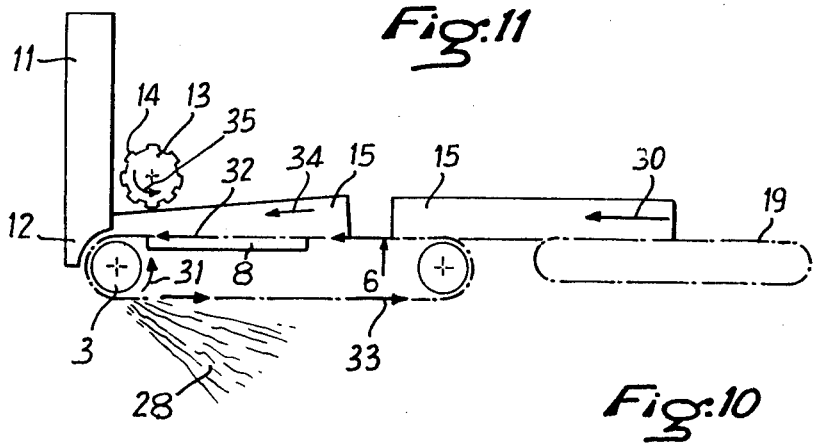
FIG. 11 is a view schematically illustrating the movements of the grinding members during a shredding operation.
Figure 10:
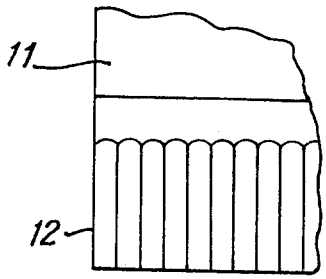
FIG. 10 is a front view of the comb profile.

The operation of the machine is illustrated in FIG. 11.

The compact materials 15 discharged from a not shown hopper onto the feed mechanism 19 are transported on the upper side 6 of chain belt 2 in accordance with arrow 30. The front driving shaft 3 is rotated according to arrow 31. Consequently belt 2 rotates about shafts 3 and 4 in such a way that the upper lap 6 circulates from the back to the front (arrow 32) whilst the lower side 7 circulates from the front to the back (arrow 33).

We have seen that the cutting edge 27 (shown in thick lines on the drawing) of teeth 9 and 22 is located on the outer face of the chain belt. These teeth shred the lower surface of the logs whilst being supported by table 8. Front protruberances 27*a* carried by the teeth, limit the penetration into the material to be shredded. During this work, the chain belt drives the logs 15 towards the front (arrow 34), i.e. towards end stop member 11.

This action is opposed by transverse roller 13, which rotates in accordance with arrow 35 in such a way that the grooves 14 of this roller act on the upper surface of the logs 15 to displace them rearwards. However, the roller is preferably located in the vicinity of the belt to act on the front surface of the piece of wood. Thus, the superimposing of the working areas of adjacent chains makes it possible to act over the entire width of the chain belt. Grooves are not cut into the plank. Moreover, the action of the regulatable grooved roller 13 prevents the logs 15 from being seized by the teeth 9 so that they do not jam between the chain belt and stop member 11. In known devices, the compact material to be defibred must have a minimum thickness, but this is not the case here. Moreover, the profile of comb 12 makes it possible to completely shred the wood and obtain fibres 28 within the desired dimension range.

Figure 12:
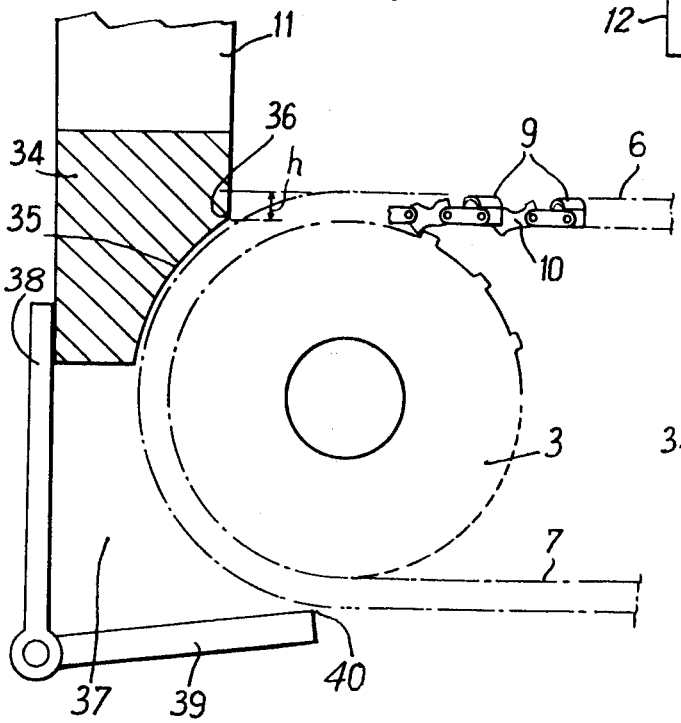
FIG. 12 is a view showing schematically the front portion of a shredding belt in a second embodiment.

FIG. 12 shows the sides of chains 6 and 7 and the countershaft 3. Stop member 11 carries a member 34, in this case made from wood or from any softer material than the gouges, whose lower profile 35 follows, with a limited clearance, the circular trajectory of the top of gouges 9. It can be seen that the beginning 36 of the circular arc portion 35 is located below the horizontal plane traversed by the tops of the gouges 9 by distance *h*.

This has the advantage that the thin remnants of logs being defibred are constantly supported against the vertical surface represented by the stop member 11 and member 34. Moreover, the residual thicknesses of the logs or slabs remain supported against the stop member until substantially complete grinding has taken place without engaging beneath surface 35. It is in fact most frequently found that the slabs are reduced to a triangular shaped fragment. Certain of these fragments and on occasions certain slabs engage beneath surface 35 and are most frequently defibred underneath this surface, which has a relatively considerable angular length, as can be seen in the drawing. If the fragments or slabs leave surface 35, they are then projected under the action of centrifugal force to a chamber 37 comprising a wall 38 which continues member 34 and a second wall of a member 39, preferably articulated to wall 38 and whose end 40 is at a very limited distance from the path or travel of the upper ends of teeth 9 in the lower portion of shaft 3.

Whilst the fragments are projected into chamber 37, the fibres continue to be driven by the chains beyond end 40 and finally leave the latter and fall downwards. The fragments accumulating in chamber 37 pack together and are then broken down into relatively short fibres which are then discharged.

Moreover, as member 34 is made from wood, it can be located very close to shaft 3. The height of member 34 and stop member 11 can be regulated to compensate wear relative to surface 35.

Figure 13:
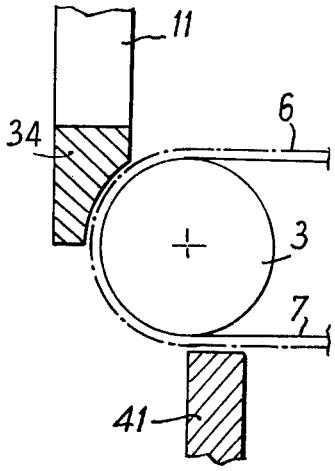
FIG. 13 is a schematic view of another embodiment of the machine according to the invention.

In the embodiment shown in FIG. 13, stop member 11 and member 34 are the same as before. In this case, a second member 41 is provided beneath shaft 3 and at a very limited spacing from the side of lower chain 7. This member 41 prevents the passage of large fragments towards the lower side 7.

It can be seen that there is a free space between members 34 and 41 into which the fragments or slabs are projected under the action of centrifugal force during the rotation of the chains about shaft 3. The said fragments or slabs are prevented from passing beyond member 41. However, the fibers which are cut out by the gouges, continue their fibres to the level of lap 7 where they naturally leave the chains, because they are not specially sensitive to the centrifugal force.

I claim:

1. Machine for shredding fibrous material, said machine comprising:

an endless belt carrying defibering gouges, front and rear shafts over which said belt travels, to form an upper lap above said shafts and a lower lap beneath them, stop means positioned near that end of the upper lap toward which said upper lap travels, to receive the end of the unshredded fibrous material and prevent its passage therebeyond, and a member closely adjacent said upper lap which permits the passage of shredded material therethrough but prevents the passage of large chips, said member having an arcuate surface defining, with the portion of said belt passing over said front shaft, a narrow gap sufficient to prevent said gouges from striking said arcuate surface, but insufficient to pass large chips.

2. A machine according to claim 1, wherein the endless belt comprises a plurality of juxtaposed toothed chains.

3. A machine according to claim 1, wherein the beginning of said arcuate surface is located at a lower level than the trajectory of the gouge teeth on the upper lap.

4. A machine according to claim 1, wherein each chain of the belt has intermediate secondary links which are supported and guided along a support table located between the upper and lower laps of the belt.

5. A machine according to claim 4, wherein each chain comprises at least two types of links, namely shredding links having profiled cutting edges on the outside of the endless belt and connecting links located between two shredding links of the same chain and having on the inner surface of the endless belt a protuberance permitting the guidance of the chain on the support table for the upper lap of the belt.

6. A machine according to claim 5, wherein all the links and secondary links of all the chains are integral with transverse parallel pins, whilst on the same transverse pin are provided the shredding link of one chain and the connecting link of the adjacent chain, whereby the transverse shredding profiles of two adjacent chains are slightly staggered during the longitudinal movement of the belt, so that the upper active side of the chain belt works over the entire width of the fibrous material to be shredded, whereby certain of the profiles are oriented to the right and the others to the left, while regularly distributed over the belt.

7. A machine according to claim 1 which comprises a pressing member constituted by a surface which in its rear portion pivots about a horizontal transverse axis, whilst elastic restoring means bias this pressing member against the upper surface of the material to be shredded, which is thus flattened against the upper side of the chain belt and in particular on the shredding links.

8. A machine accordng to claim 1 in which said arcuate surface terminates above a horizontal plane passing through the axis of said front shaft.

9. Machine for shredding fibrous material, said machine comprising:

an endless belt carrying defibering gouges, front and rear shafts over which said belt travels, to form an upper lap above said shafts and a lower lap beneath them, stop means positioned near that end of the upper lap, toward which said upper lap travels, to receive the end of the unshredded fibrous material and prevent its passage therebeyond, means permitting the passage of fibres beyond said stop means while preventing the passage of large chips, a longitudinally grooved roller extending transversely over said belt beside said stop means, and means for driving said roller in a direction opposite to that in which shafts turn.

10. A machine according to claim 9, wherein a motor drives one of the shafts over which said belt travels, driving means being mounted at one of the ends of said one shaft to mesh with a pinion integral with the grooved roller in such a way that the upper lap of the belt drives the unshredded fibrous material towards the stop member, whilst the grooved roller drives the same material in the opposite direction.

11. Machine for shredding fibrous material, said machine comprising:

an endless belt carrying defibering gouges, front and rear shafts over which said belt travels, to form an upper lap above said shafts and a lower lap beneath them, stop means positioned near that end of the upper lap, toward which said upper lap travels, to receive the end of the unshredded fibrous material and prevent its passage therebeyond, means positioned beyond said stop means to prevent the passage of large chips but permit the passage of shredded fibres, said means comprising a substantially closed chamber partially encircling the shaft toward which said upper lap travels, said chamber comprising a wall member in the immediate vicinity of the path of travel of the gouges and generally beneath said last mentioned shaft to permit the accumulation in said chamber of large chips which have passed said stop means.

12. Machine for shredding fibrous material, said machine comprising:

an endless belt carrying defibering gouges, front and rear shafts over which said belt travels, to form an upper lap above said shafts and a lower lap beneath them, stop means positioned near that end of the upper lap toward which said upper lap travels, to receive the end of the unshredded fibrous material and prevent its passage therebeyond, means positioned beyond said stop means to prevent the passage of large chips but permit the passage of shredded fibres, said means comprising a second stop means beneath the shaft toward which said upper lap travels, at a very small distance from the gouges.

* * * * *